United States Patent [19]

Lee

[11] Patent Number: 4,846,706

[45] Date of Patent: Jul. 11, 1989

[54] ELECTRIC PLUG

[76] Inventor: Hop Lee, 2455 - 24th Ave., San Francisco, Calif. 94116

[21] Appl. No.: 178,012

[22] Filed: Apr. 5, 1988

[51] Int. Cl.[4] ..... H01R 4/66

[52] U.S. Cl. ..... 439/104; 439/457

[58] Field of Search ..... 439/103, 104, 456–458, 439/461–463

[56] References Cited

U.S. PATENT DOCUMENTS 4,174,874 11/1979 Lee ..... 439/104

FOREIGN PATENT DOCUMENTS 95129 6/1922 Switzerland ..... 439/457

*Primary Examiner*—Eugene F. Desmond

*Attorney, Agent, or Firm*—Linval B. Castle

[57] ABSTRACT

An electric plug for connection to an electric cable, the core of the plug having sidewall slots for the wires of a cable and a positive contact with the plug blades by a wiping action, thus obviating the need for threading wires through holes and the tightening of screws on the wires. Other improvements include an improved cable clamping device within the plug and an improved pivoting ground pin with extending screw tab.

7 Claims, 3 Drawing Sheets

12
14
16
18
20
22
24
26
28
30
31
32
34
36
38
40
42
44
46
48
50

ELECTRIC PLUG

Background of the Invention

This invention relates generally to electrical cable connectors and in particular to improvements in electric plugs.

Specifically, the invention relates to improvements in the electric plugs described in one or more of my U.S. Pat. Nos. 4,174,874, 4,178,056, 4,199,207, 4,293,178, and 4,354,723. The improvements include a grounding lug coupled to the pivoting ground pin in U.S. Pat. No. 4,174,874 keyholes for mounting cable securing wedges shown in U.S. Pat. No. 4,293,178 a new wedged plug insert for securing the terminal blades within the plug, and a novel design for passing conductors through an open slot in the core of the plug and in wiping contact with the blade terminals thus obviating the need for threading them through holes to their respective contacts.

Description of the Drawings

In the drawings which illustrate the preferred embodiments of the electric plug improvements.

Description of the Preferred Embodiment

Figures 1, 2, 3, 4:
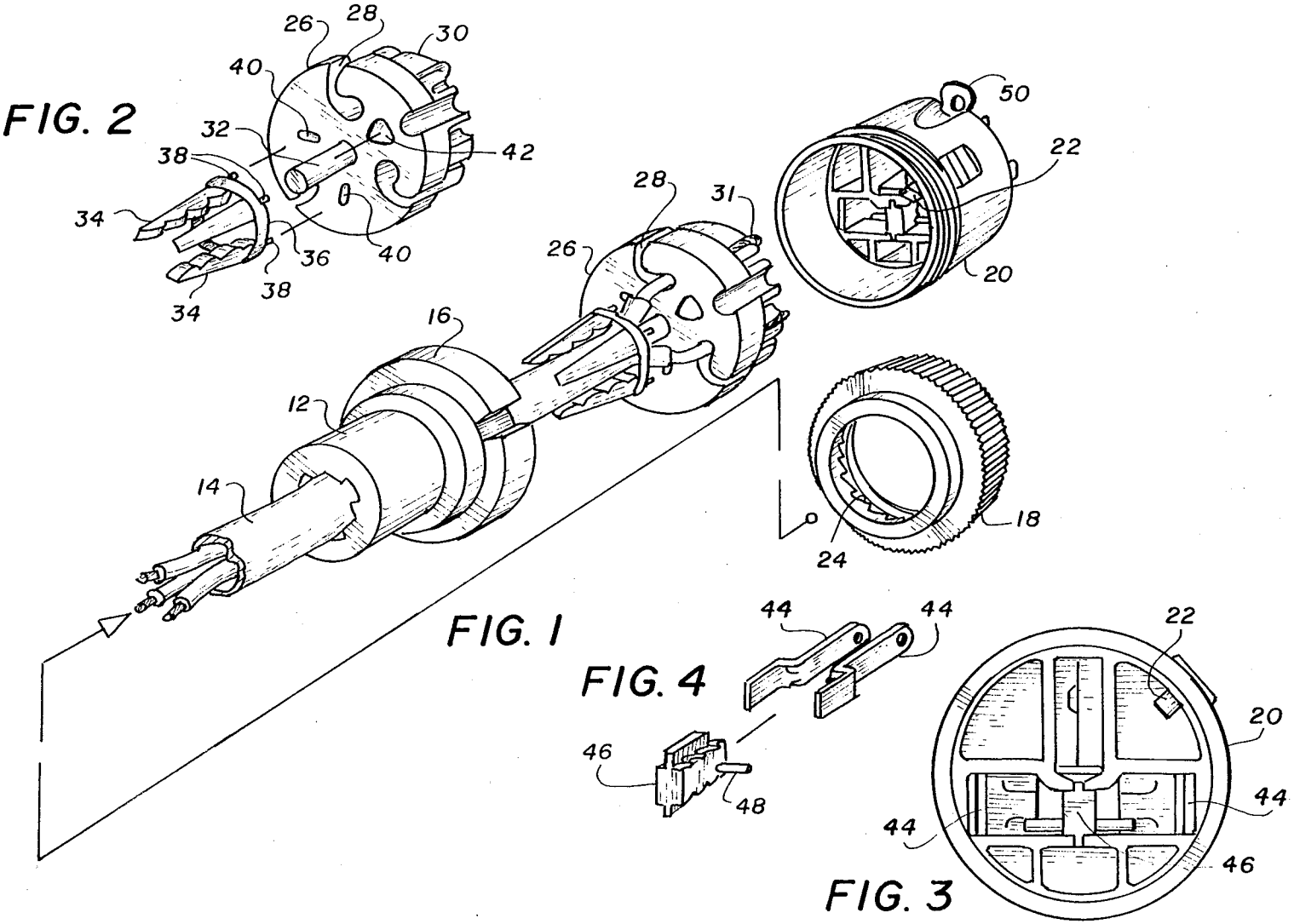
FIG. 1 is a perspective view of a cable connector illustrating the various components thereof.
FIG. 2 is a perspective view illustrating the mounting of a cable securing wedge and the wire attachments in the terminal carrier of the connector of FIG. 1.
FIG. 3 is an end view of the cylindrical main body of the electrical plug of FIG. 1.
FIG. 4 is a perspective view of a plug for securing the two contact blades of the male plug in the main body of the connector.

FIG. 1 illustrates the components of a male cable connector having two parallel blades and a ground connector or pin. The connector includes a tubular sleeve 12 which receives the electrical cable 14 and which has an annular shoulder 16 against which a threaded cap 18 is seated. When installed on the sleeve 12, the cap 18 may be screwed on matching threads on the main cylindrical body 20 which contains the connector blades and the ground pin.

Also within the main body 20, and operable from its exterior surface, is a longitudinal locking pin 22 which passes through a slot in the periphery of the annular shoulder 16 to engage an annular ring of rachet teeth 24 in the threaded cap 18. Thus, when installed, the cap 18 is removable only by retracting the locking pin 22 as described in my U.S. Pat. No. 4,354,723.

Contained within the main body 20 of the plug is a terminal carrier 26 which receives the ends of the cable 14 and passes the bare conductors around the exterior of the carrier and into hook-shaped longitudinal slots 28 where the bare wires emerge near the center of the carrier, as best shown in FIG. 2. The bare wires are then passed over the end sections 30 of the carrier 26 and back down the exterior of the end sections 30 so that, when the carrier is installed in the main body of the plug, the bare wires 31 at the exterior of the sections 30 will make positive rubbing contact with the surfaces of the connector blades as shown in FIG. 3.

The terminal carrier 26 is illustrated in better detail in FIG. 2. The carrier is shown with the hook-shaped longitudinal wire slots 28 which permit easy and quick installation of the wires in a connector in that there are no holes to thread a wire into and no screws to tighten against bare wires. The rear face of the carrier 26 which receives the cable before it is stripped has an axial post 32 which serves to separate and hold apart the three insulated conductors in the cable. This face is also coupled to a group of three serrated wedges 34 which very tightly secure the cable and prevent its removal when the sleeve 12 and main body 20 are screwed together. Similar wedges are described in earlier patents including U.S. Pat. No. 4,293,178. However, the wedges 34 herein are tied together at their large ends by a flexible ring 36 and each wedge is loosely secured against the face of the carrier 26 by a round pin 38 in the end of each wedge that engages a surface hole in the face of the carrier. The coupling of the wedges to the carrier face prevents rotation and misalignment of the group of wedges during tightening of the sleeve 12 and main body 20 and assures a very tight locking of a cable.

To be properly tightened against an incoming cable, the wedges 34 must be capable of a small radial movement against the surface of the terminal carrier 26. Further, one of the wedges must also be capable of a small circumferential movement about the axis of the carrier. Hence, two of the surface holes 40 in the face of the carrier must be radially elongated to accomodate radial movement of their respective wedges, and a third surface hole 42 must be triangular, as shown, to permit both radial and circumferential movement of its wedge.

FIG. 3 is a view looking directly into the interior end of the cylindrical main body 20 of the connector. Illustrated is the cap locking pin 22 and its sliding actuator on the exterior of the body. When the terminal carrier 26 is inserted into the body, the bare wires which have passed through the slots and over the end of the terminal carrier 26 are in position to make positive contact with the conductive blades 44 which are originally loosely positioned in recesses formed in the interior side walls of the carrier. When positioned in their respective wall recesses, the blades are tightly secured in the recesses by a small rectangular non-conductive plug 46 which has side extensions 48 that will bear against the ends of the blades. The plug 46, best shown in FIG. 4, snugly fits within a rectangular slot longitudinally positioned between the two blades and is held within its slot by the front face of the installed terminal carrier.

Returning for the moment to FIG. 1, the main body 20 is shown with a tab 50 extending from the side surface on the end of the body supporting the parallel connector blades. This tab 50 is best illustrated in FIGS. 5–8 and is a part of the pivotable ground pin. The pivoted pin is described in my U.S. Pat. No. 4,174,874 and the improvement shown herein permits a cable connector either to be secured to a duplex outlet by the centrally positioned cover plate screw in the outlet or provides a connecting lug for wiring the connector to a nearby water pipe ground.

Figure 5:
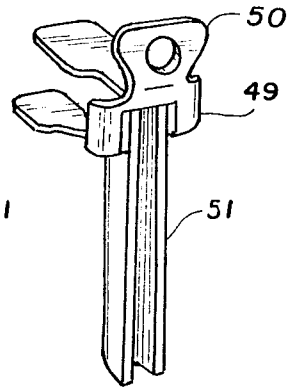
FIGS. 5 and 6 are perspective views of the pivoted grounding pin of the electric plug in its recessed and extended positions, respectively, and further illustrates a grounding lug for attachment of the plug to an outlet box.
Figure 6:
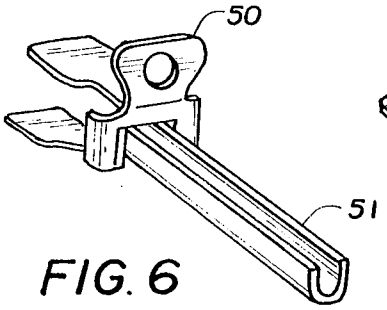
Figure 7:
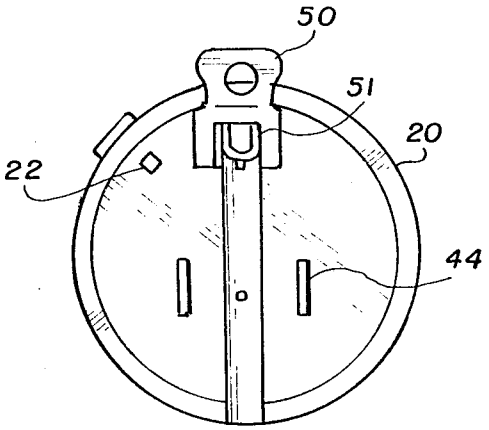
FIG. 7 is a view of the recessed grounding pin pivoted into the face of the plug.

FIG. 5 illustrates the ground pin 51 mounted on a flush plate 49 that has its edges slightly turned down to eliminate sharp edges. FIG. 6 illustrates the pin 51 pivoted up into operating position. FIG. 7 is a plan view illustrating the end surface of the main connector body 20 with the grounding pin 51 pivoted up as in FIG. 6. Also illustrated in FIG. 7 is an opening for the end of the cap locking pin 22 which extends from the opposite end to engage the rachet 24 in the threaded cap 18. The advantage of also extending the pin 22 from the blade end of the body is that the pin 22 cannot be operated to remove the threaded cap 18 when the main body 20 is coupled into an outlet or other connector because the presence of the outlet will prevent the pin from extending from the body surface.

Figure 8:
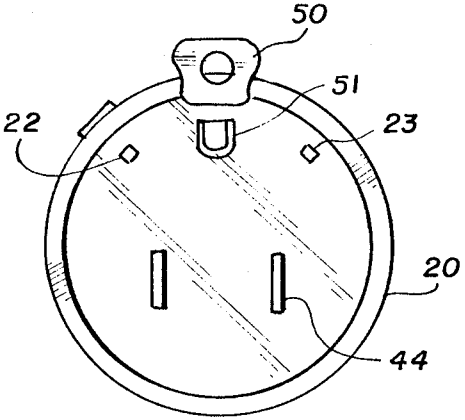
FIG. 8 illustrates the plug face of FIG. 7 with insulating cover attached.

FIG. 8 is a plan view illustrating the end surface of the main connector body as in FIG. 7, but with an insulating "cardboard" cap installed. The cap has a clearance hole for the cap locking pin 22 and also a corresponding hole 23 opposite the pin 51 so that the cap may be reversed. The corresponding hole 23 also provides a simple means for prying the cap from the connector.

FIGS. 9–15 illustrate the principles of the invention adapted to a twist-lock type of connector having three equally spaced blades.

Figure 9:
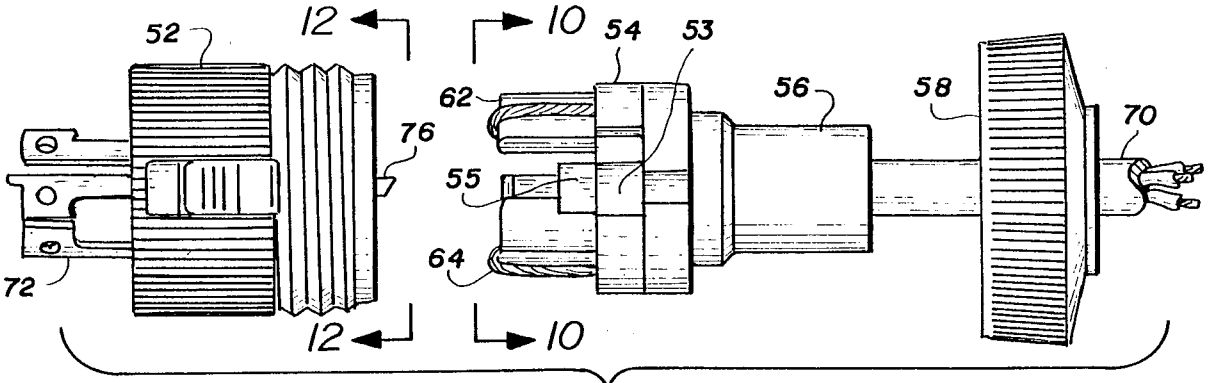
FIG. 9 is a component view of a twist-lock type of electric plug.

FIG. 9 is a side elevational view illustrating the various components of the three connector plug of the invention and illustrates a main body 52 containing the three blades, a terminal carrier 54 coupled to a sleeve 56 and the threaded end cap 58 which abuts an annular shoulder 60 on the sleeve and screws to the main body.

Figure 10:
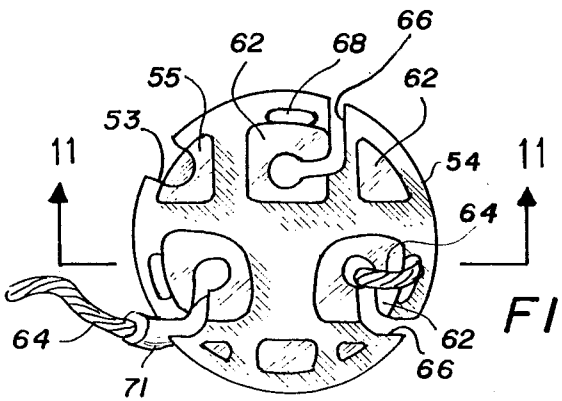
FIG. 10 is a face view of a terminal carrier or core of a twist-lock type of plug and illustrates the entry path of the three wires.

FIG. 10 is an end view of the terminal carrier 54 taken along the lines 10—10 of FIG. 9 and illustrates a plurality of lands 62 that extend above the lower surfaces of the carrier. Each bare wire 64 from a cable is passed through a hook or L-shaped slot 66 that is open to the periphery of the carrier and terminates in a land 62 that has a side surface adjacent and substantially parallel with the arcuate periphery of the carrier. The bare wire extending above the top surface of its land is then bent over and down the side surface and its end is inserted into a hole 68 in the lower surface so that the bare wire will make a wiping contact with a conductive blade when the carrier 54 is inserted into the main body 52 of the connector.

FIG. 9 also illustrates clearance slots 53 in the peripheries of the terminal carrier 54 and the sleeve 56 for the cap locking pin. It will be noted that the slot 53 in the carrier 54 is somewhat wider than that in the sleeve 56 and also that the land 55 containing the carrier slot 53 is shorter than other lands 62. This shorter land 55 is necessary to prevent interference with the movement of the cap locking pin within the main body 52.

Figure 11:
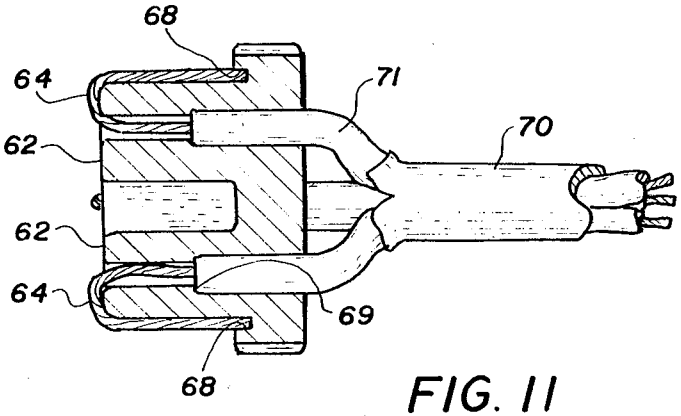
FIG. 11 is a sectional view of the terminal carrier of the plug taken along the lines 11—11 of FIG. 10

FIG. 11 is a sectional view taken along the lines 11—11 of FIG. 10 and illustrates a cable 70 separated into three wires 71 which, when stripped of their insulation, are passed through the slots, around the ends of the lands 62, and back down the exterior land surface and into the holes 68 in the terminal carrier. The slots are preferably enlarged approximately half the thickness of the terminal carrier 54 to permit the insulation on the three wires 71 to enter that portion of the slots, and then narrowed, as shown at 69, to restrict the slot space to bare wires 64.

Figure 14:
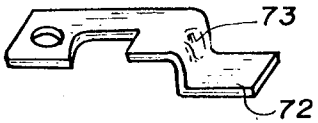
FIG. 14 is a perspective view of one contact blade in the plug of FIG. 9.
Figure 12:
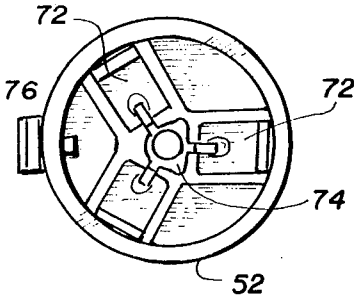
FIG. 12 is a view looking into the main body of the plug of FIG. 9.

FIG. 12 is a view looking into the main body 52 of the connector and shows the interior surfaces of the three connector blades 72. As best illustrated in FIG. 14, the blades 72 are bent into a Z-shape so that the surfaces on the interior of the main body 52 will lie against the inside side surface of the body. As will be explained later, a recess or dimple 73 is formed in the center of each blade at the bend which will be located near the center of the main body 52. When a terminal carrier 54 with wires coupled thereto is inserted into the main body, the wires 64 will make positive electrical contact against the interior surface of blades 72.

Figure 13:
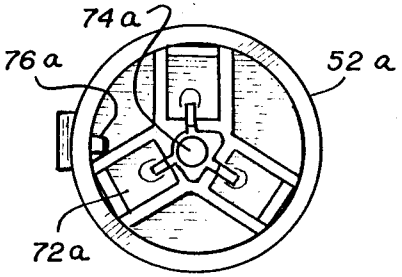
FIG. 13 is a view similar to that of FIG. 12 but with the terminal carrier angularly shifted.

The blades 72 are installed in the main body by inserting them from inside the body into slots in the end of the body. To secure the blades in the body a triangular wedge 74 is pressed into a mating cavity formed in the center of the carrier, as shown in FIG. 12. FIG. 13 illustrates a very similar configuration but with connector blades displaced from the position of the threaded cap locking pin 76*a*. The body 52*a* of FIG. 13 is that of the female portion of the connector which may replace the main body 52 and may be coupled to the terminal carrier 54 of FIG. 9 to form a complete female connector.

Figure 15:
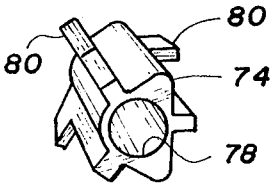
FIG. 15 is a perspective view of a plug, similar to that of FIG. 4, for securing the contact blades in the plug body of FIG. 12.

As shown in better detain in FIG. 15 the wedge 74 is formed with a triangular body which fits into a mating cavity centrally located in the interior of the main body 52. The wedge has three radial fins or wings 80 which are pressed down against the center portion of the Z-shaped blades 72 to and into the blade dimples 73 to secure the blades in their proper positions.

Having thus described my invention, what I claim is:

1. An electric plug for connecting an electric cable to an electrical receptacle, said plug comprising:

a cylindrical main body having first and second ends, said first end being closed and having a plurality of conductive blades extending from its exterior surface and into the interior of said body, said blades being positioned to enable the insertion of the plug into an electrical outlet;

a cylindrical cable receiving sleeve located at the second end of said body, said sleeve being secured to said body by a threaded nut engaging corresponding threads around the second end of said cylindrical body;

a terminal carrier having first and second ends, said carrier positioned within said body and said sleeve, said carrier receiving from said sleeve at its first end the wires of a cable entering said sleeve and pressing uninsulated ends of said wires against conductive blades in the interior of said body;

said terminal carrier having longitudinal wire slots in its side surface, said slots opening into longitudinal holes through said carrier for the passage of said uninsulated wires from the first end of said carrier to the second end of said carrier, said second end having raised land areas around a portion of said holes, said uninsulated wires being passed over said land areas and down the side surfaces of said carrier for electrical contact with said conductive blades; and a plug member insertable in a matching cavity centrally positioned in the main body, said plug member having extending portions that contact central portions of said blades within said body for tightly securing said blades in said body.

2. The electric plug claimed in claim 1 further including a plurality of cable clamping wedges having thicker ends abutting the first end of said terminal carrier, said wedges being compressed against a cable by said sleeve, said wedges having serrated interior surfaces for gripping a cable entering said sleeve, said thicker wedge ends having a pin extending therefrom for engaging openings in the first end of said terminal carrier, each of said openings being shaped to permit a small radial movement of its respective wedge, at least one of said openings being shaped to permit a small circumferential movement of its wedge around the longitudinal axis of said carrier.

3. The electric plug claimed in claim 1 wherein said blades have substantially a Z-shape, a first leg of said shape extending from said plug, a second leg lying within said plug and against an interior wall of said main body, the portion between said first and second legs being bent and having, at said bend, a recessed dimple for receiving said extending portions of said plug member.

4. The electric plug claimed in claim 1 wherein said plug member is secured in its matching cavity by the second end of said terminal carrier.

5. The electric plug claimed in claim 1 wherein the first end of said main body contains a plurality of conductive blades and a grounding pin, said pin being pivotally mounted on a conductive grounded plate member having a ground tab extending therefrom and from the surface of the cylindrical main body, said ground tab having a hole therein for securing the electric plug to an outlet box.

6. The electric plug claimed in claim 1 further including locking means for preventing the unscrewing of said threaded nut from said cylindrical body while the conductive blades of said plug are inserted into an electrical outlet.

7. The electric plug claimed in claim 6 wherein said locking means includes an annular ratchet formed in the interior surface of said threaded nut and a longitudinally slideable pin within said main body, said pin having a length extending from locking engagement with said ratchet to a point flush with the first end of said main body.

* * * * *